US011295574B2

(12) United States Patent
Hawkins et al.

(10) Patent No.: US 11,295,574 B2
(45) **Date of Patent: *Apr. 5, 2022**

(54) ELECTRONIC GAMING SYSTEM FOR AWARDING MULTIPLE OF WAGER AND METHOD OF USE

(71) Applicant: Aristocrat Technologies Australia Pty Limited, North Ryde (AU)

(72) Inventors: Ryan Hawkins, Henderson, NV (US); Robert Honeycutt, Henderson, NV (US); Stephanie Johns, Las Vegas, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 0 days.

This patent is subject to a terminal disclaimer.

(21) Appl. No.: 17/081,698

(22) Filed: Oct. 27, 2020

(65) Prior Publication Data

US 2021/0043034 A1 Feb. 11, 2021

Related U.S. Application Data

(63) Continuation of application No. 16/209,236, filed on Dec. 4, 2018, now Pat. No. 10,839,638, which is a (Continued)

(51) Int. Cl.
*G07F 17/32* (2006.01)

(52) U.S. Cl.
CPC ..... *G07F 17/3213* (2013.01); *G07F 17/326* (2013.01); *G07F 17/3209* (2013.01); (Continued)

(58) Field of Classification Search
USPC ..... 463/20
See application file for complete search history.

(56) References Cited

U.S. PATENT DOCUMENTS 6,869,360 B2 3/2005 Marks
7,329,179 B2 2/2008 Baerlocher
(Continued)

FOREIGN PATENT DOCUMENTS

AU 2004235604 B2 11/2010

OTHER PUBLICATIONS

AU Examination Report in AU Application No. 2019200783, dated Oct. 9, 2019. 3 Pages.
(Continued)

*Primary Examiner* — Pierre E Elisca
(74) *Attorney, Agent, or Firm* — Armstrong Teasdale LLP

(57) ABSTRACT

An electronic gaming machine is provided, including a player interface, a meter, a game display, and a game controller. The player interface is configured to receive a wager for a round of the wagering game. The meter is configured to record a wager amount for the round. The game display is configured to display a matrix of symbols. The game controller is coupled to the meter and the game display. The game controller is configured to conduct the round of the wagering game, including selecting the matrix of symbols. The game controller is further configured to detect a trigger symbol among the matrix of symbols. The trigger symbol corresponds to a multiplier feature. The game controller is further configured to award a multiple of the wager amount according to the multiplier feature.

20 Claims, 6 Drawing Sheets

Related U.S. Application Data continuation of application No. 15/275,404, filed on Sep. 25, 2016, now Pat. No. 10,176,665.

(52) U.S. Cl.
CPC ..... *G07F 17/3237* (2013.01); *G07F 17/3246* (2013.01); *G07F 17/3248* (2013.01); *G07F 17/3251* (2013.01); *G07F 17/3258* (2013.01)

(56) References Cited

U.S. PATENT DOCUMENTS

| | | | | |
|---|---|---|---|---|
| 7,867,077 | B2 | 1/2011 | Baerlocher | |
| 8,197,330 | B2 | 6/2012 | Englman | |
| 8,425,305 | B2 | 4/2013 | Baerlocher | |
| 8,696,438 | B2 | 4/2014 | Englman | |
| 8,858,319 | B2 | 10/2014 | Schultz | |
| 8,864,568 | B2 | 10/2014 | Mizue | |
| 9,336,658 | B2 | 5/2016 | Suda | |
| 9,378,626 | B2 | 6/2016 | Aida | |
| 10,176,665 | B2 * | 1/2019 | Hawkins | G07F 17/3209 |
| 10,839,638 | B2 * | 11/2020 | Hawkins | G07F 17/3251 |
| 10,957,155 | B2 * | 3/2021 | Tam | G07F 17/34 |
| 2004/0048646 | A1 | 3/2004 | Visocnik | |
| 2005/0288093 | A1 | 12/2005 | Englman | |
| 2008/0274789 | A1 | 11/2008 | Singer | |
| 2010/0279760 | A1 | 11/2010 | Sugiyama | |
| 2013/0065663 | A1 | 3/2013 | Johnson | |
| 2014/0274348 | A1 | 9/2014 | Baerlocher | |
| 2014/0342802 | A1 | 11/2014 | Itagaki | |
| 2015/0170460 | A1 | 6/2015 | Marais | |
| 2015/0348374 | A1 | 12/2015 | Dupuis | |
| 2018/0082546 | A1 * | 3/2018 | Mariscal | G07F 17/34 |
| 2018/0089930 | A1 * | 3/2018 | Hawkins | G07F 17/3251 |
| 2018/0089953 | A1 | 3/2018 | Palmisano | |
| 2019/0096168 | A1 * | 3/2019 | Salmon | G07F 17/34 |
| 2019/0108719 | A1 * | 4/2019 | Hawkins | G07F 17/3248 |
| 2021/0005059 | A1 * | 1/2021 | Palmisano | G07F 17/3211 |
| 2021/0264734 | A1 * | 8/2021 | Palmisano | G07F 17/3211 |

OTHER PUBLICATIONS

Notice of Action dated Aug. 18, 2020 for U.S. Appl. No. 16/209,236 (pp. 1-9).
Australian Examination Report for App No. 2019200980, dated Apr. 8, 2020, 2 pages.
Office Action dated Mar. 31, 2021 for U.S. Appl. No. 16/686,622 (pp. 1-5).
Notice of Allowance dated May 14, 2021 for U.S. Appl. No. 16/686,622 (pp. 1-5).
Australian Examination Report No. 1 for AU2020239633 dated Jun. 8, 2021, 4 pages.

* cited by examiner

ELECTRONIC GAMING SYSTEM FOR AWARDING MULTIPLE OF WAGER AND METHOD OF USE

CROSS-REFERENCE TO RELATED APPLICATIONS

This application is a continuation of U.S. patent application Ser. No. 16/209,236, filed Dec. 4, 2018, entitled "ELECTRONIC GAMING SYSTEM FOR AWARDING MULTIPLE OF WAGER AND METHOD OF USE", which is a continuation of U.S. patent application Ser. No. 15/275,404, now U.S. Pat. No. 10,176,665, filed Sep. 25, 2016, entitled "ELECTRONIC GAMING SYSTEM FOR AWARDING MULTIPLE OF WAGER AND METHOD OF USE", the entire contents and disclosures of which are hereby incorporated by reference in their entireties.

BACKGROUND

The embodiments described herein relate generally to electronic gaming systems and methods that conduct wagering games and, more particularly, to an electronic gaming system that utilizes a multiplier feature to award a multiple of an amount wagered.

Generally, many known electronic gaming machines conduct wagering games, such as, for example, reel games. In such games, symbols are randomly selected and displayed in a matrix of symbols on a game display. The wagering game defines one or more win conditions, the occurrence of which results in a win amount being awarded. Typically, reel games define win conditions as win-lines defined across at least a portion of the matrix on the game display. For each round of play, when a certain combinations of symbols appear along a win-line, the reel game awards a win amount, or winnings, corresponding to that combination of symbols and that win-line. Win amounts vary according to the combination of symbols and according to the particular win-line along which the combination of symbols appears. Win amounts are typically determined according to a pay table defined for the wagering game, where the pay table comprehends the various combinations of symbols and win-lines, i.e., the win conditions that may occur in the wagering game. In many reel games, the win amount for a round of play may be a fraction of an amount wagered for that round of play for certain win conditions. For other win conditions, the win amount may be much larger than the amount wagered.

Many known electronic gaming machines include bonus features that, when triggered, result in an additional award, or bonus award, to the player. Such bonus features are incorporated into many wagering games to enhance the electronic gaming machines through additional elements of excitement and chance. One such bonus feature is a multiplier feature. Multiplier features are triggered, for example, by an occurrence of a trigger symbol in the matrix of symbols displayed on the electronic gaming machine. Multiplier features typically define a scalar value by which winnings are multiplied and the multiple awarded. For example, in reel games, when a trigger symbol appears in the matrix of symbols for a round of play, a scalar value is multiplied by any winnings for that round of play, and the multiple of the winnings is awarded. The multiplier feature may apply for only the round of play in which the trigger symbol appeared, or may apply for multiple rounds of play of the wagering game. Likewise, the multiplier feature applies equally to small win amounts and large win amounts, providing an even wider range of potential winnings and excitement.

Multiplier features improve known electronic gaming machines by introducing an additional opportunity for players of wagering games conducted thereon to win multiples of win amounts they would otherwise be awarded. Such multiplier features enhance the electronic gaming machines and the experience of players through additional elements of excitement and chance.

BRIEF DESCRIPTION

In one aspect, an electronic gaming machine is provided, including a player interface, a meter, a game display, and a game controller. The player interface is configured to receive a wager for a round of the wagering game. The meter is configured to record a wager amount for the round. The game display is configured to display a matrix of symbols. The game controller is coupled to the meter and the game display. The game controller is configured to conduct the round of the wagering game, including selecting the matrix of symbols. The game controller is further configured to detect a trigger symbol among the matrix of symbols. The trigger symbol corresponds to a multiplier feature. The game controller is further configured to award a multiple of the wager amount according to the multiplier feature.

In another aspect, a method of conducting a wagering game on an electronic gaming machine is provided. The method includes receiving a wager through a player interface for a round of the wagering game. The method includes recording a wager amount for the round in a meter. The method includes displaying a matrix of symbols on a game display. The matrix of symbols includes a trigger symbol corresponding to a multiplier feature. The method includes detecting the trigger symbol. The method includes awarding a multiple of the wager amount according to the multiplier feature.

In yet another aspect, a gaming system is provided, including a server, a first electronic gaming machine, and a second electronic gaming machine. The server is coupled to a network. The server is configured to transmit a definition of a first bonus feature and a definition of a second bonus feature onto the network. The first electronic gaming machine is configured to conduct a first wagering game. The first electronic gaming machine is coupled to the network and is further configured to receive the definition of the first bonus feature. The first electronic gaming machine is further configured to receive a first wager for a round of the first wagering game, during which the first bonus feature is triggered. The first electronic gaming machine is further configured to compute a first minimum bonus award according to an amount of the first wager and the first bonus feature. The second electronic gaming machine is configured to conduct a second wagering game. The second electronic gaming machine is coupled to the network and is further configured to receive the definition of the second bonus feature. The second electronic gaming machine is further configured to receive a second wager for a round of the second wagering game, during which the second bonus feature is triggered. The second electronic gaming machine is further configured to compute a second minimum bonus award according to an amount of the second wager and the second bonus feature.

BRIEF DESCRIPTION OF THE DRAWINGS

The embodiments described herein may be better understood by referring to the following description in conjunction with the accompanying drawings.

DETAILED DESCRIPTION

Figure 1:
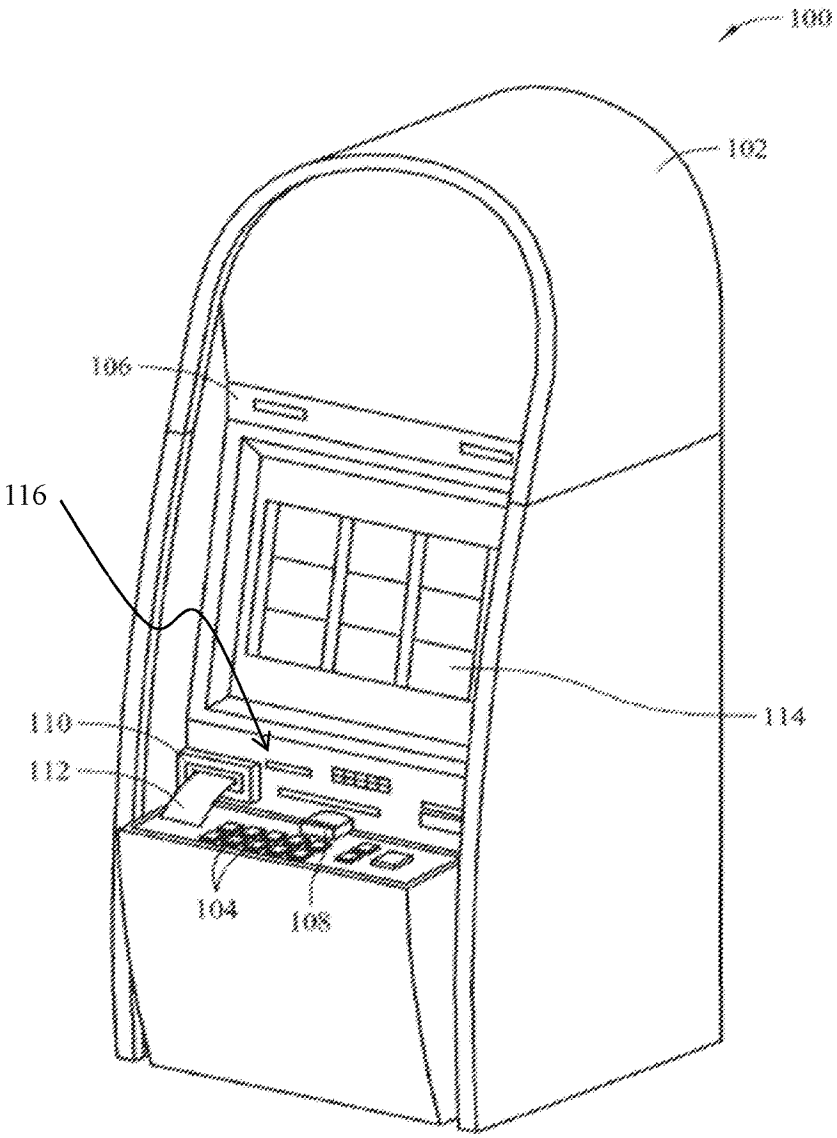
FIG. 1 is a perspective diagram of an exemplary electronic gaming machine.

According to embodiments of the present disclosure, gaming systems, electronic gaming machines, and methods of conducting wagering games are described herein. The gaming systems, electronic gaming machines, and methods described herein enable the implementation of a wagering game that includes a multiplier feature. In such embodiments, the multiplier feature is triggered in a round of play of the wagering game. The multiplier feature is applied to both winnings for that round of play and to the wager amount for that round of play. The player is then awarded both a multiple of the winnings and a multiple of the wager amount for that round of play.

Many electronic gaming machines include a bonus feature that, when triggered, result in a bonus award that increases the excitement of the wagering game and enhances the player experience. One such bonus feature is a multiplier feature that, when applied to a game outcome, results in a multiple of the winnings for that game outcome being awarded. Multiplier features are typically incorporated into wagering games to enhance the excitement by offering an opportunity to award a multiple of the winnings. It is realized herein that a win amount for a given round of play may be as little as zero and, accordingly, a multiple of the win amount is as little as zero. It is further realized herein the enhancement achieved by the multiplier feature or any other bonus feature is greatly diminished when the bonus award is less than the amount wagered for that round of play. For example, then enhancement achieved by a multiplier feature is greatly diminished when a multiple of the winnings is less than the amount wagered for that round of play.

It is realized herein that a minimum bonus award avoids the diminishing enhancement offered by many known bonus features. Minimum bonus awards may be enabled through various means, including, for example, and without limitation, a fixed schedule of bonus awards. It is realized herein that electronic gaming machines having multiplier features are improved by enabling a minimum bonus award based on an amount wagered in the round of play that triggers the bonus feature. More specifically, electronic gaming machines described herein apply the triggered multiplier feature to the amount wagered in the round of play that triggers the multiplier feature and a multiple of the amount wagered is awarded to the player in addition to a multiple of the winnings for that round of play. Gaming systems and electronic gaming machines described herein improve conventional gaming systems and electronic gaming machines by enabling a minimum bonus award computed as a function of the amount wagered. Accordingly, it is realized herein, when the multiplier feature is triggered in a round of play, the player is awarded at least a multiple of the amount wagered in that round of play, plus a multiple of any winnings that would otherwise be awarded. In the event the winnings are zero or small relative to the amount wagered, the player is awarded the minimum bonus award as a function of the amount wagered and the wagering game is enhanced. In the event the winnings are large relative to the amount wagered, the multiple of the winnings outweighs the multiple of the amount wagered and the wagering game is enhanced The electronic gaming machines described herein may be embodied in various configurations, including, for example, and without limitation (1) an electronic gaming machine in which the computer-executable instructions for controlling one or more wagering games are stored within the electronic gaming machine prior to installation at a gaming establishment, e.g., at the factory, and (2) a configurable gaming machine in which the computer-executable instructions for controlling one or more wagering games are subsequently downloaded to the electronic gaming machine over a network after the electronic gaming machine is installed at the gaming establishment. Such configurations are referred to as "thick clients" in that the computer-executable instructions for controlling the one or more wagering games are stored in local memory and executed by a local processor, or game controller to conduct the one or more wagering game and to control the various interfaces of the electronic gaming machine. In alternative embodiments, computer-executable instructions for controlling one or more wagering games are executed by a game server, central game controller, or a remote host. Such embodiments are referred to as "thin clients" in that the game server remotely controls the one or more wagering games and certain interfaces over a network, and the electronic gaming machine displays the wagering games and provides interfaces to receive player inputs and commands.

FIG. 1 is a schematic diagram of an exemplary electronic gaming machine 100. Electronic gaming machine 100 may be any type of gaming machine, and may include, without limitation, different structures than those shown in FIG. 1, such as, for example, a personal computer, tablet computer, smart phone, personal digital assistant (PDA), cellular phone, and any other network-enabled device. Moreover, electronic gaming machine 100 may employ different methods of operation than those described below.

In the exemplary embodiment, electronic gaming machine 100 includes a cabinet 102 that houses a plurality of components, such as a gaming machine controller, peripheral devices, displays, and/or player interaction devices. For example, in an exemplary embodiment, electronic gaming machine 100 includes a plurality of user interfaces, or input devices, such as switches and/or buttons 104 that are coupled to a front 106 of cabinet 102. Buttons 104 may be used to start play of a primary or secondary game. One button 104 may be a "Bet One" button that enables the player to place a bet or to increase a bet. Another button 104 may be a "Bet Max" button that enables the player to bet a maximum permitted wager. Yet another button 104 may be a "Cash Out" button that enables the player to receive a cash payment or other suitable form of payment, such as a ticket or voucher that corresponds to a number of remaining credits. User interfaces, in certain embodiments, include one or more touch screens as user interfaces.

In the exemplary embodiment, electronic gaming machine 100 also includes a credit input device 116. Credit input device 116 may include a coin acceptor 108 for accepting coins and/or tokens, a bill acceptor 110 for accepting and/or validating cash bills, coupons, and/or ticket vouchers 112. Bill acceptor 110 may also be capable of printing tickets 112. Furthermore, in some embodiments, credit input device 116 includes a card reader or a validator for use with credit cards, debit cards, identification cards, and/or smart cards. Cards accepted by the card reader or validator may include a magnetic strip and/or a preprogrammed microchip that includes a player's identification, credit totals, and any other relevant information that may be used. In certain embodiments, credit input device 116 may include a credit input module that interfaces with a server to accept credit and wagers.

Moreover, in the exemplary embodiment, electronic gaming machine 100 includes one or more displays 114. Displays 114 are mounted to cabinet 102, and may include a primary display for displaying a primary game and a secondary display for displaying a secondary or bonus game. Displays 114 may be further configured to display credit balances, wager amounts, cumulative wagering information, payout amounts, and RTP information. Displays 114 may include, without limitation, a plasma display, a liquid crystal display (LCD), a display based on light emitting diodes (LEDs), organic light emitting diodes (OLEDs), polymer light emitting diodes (PLEDs), and/or surface-conduction electron emitters (SEDs), a speaker, an alarm, and/or any other device capable of presenting information to a user. Displays 114 may include displays utilizing a projected or reflected image, or any other suitable electronic device or display mechanism. Displays 114 may be of any suitable size and configuration, including, for example, and without limitation, circular and rectangular. Displays 114 may further include a haptic feedback mechanism.

Displays 114, in various embodiments, display a wagering game and/or accept game play data from a player. Moreover, displays 114 may display information relating to an interactive game, a wager-triggering event, or a wagering outcome. Displays 114 may, in certain embodiments, display digital signage, including, for example, advertisements for one or more games or other aspects of the gaming establishment or casino.

Figure 2:
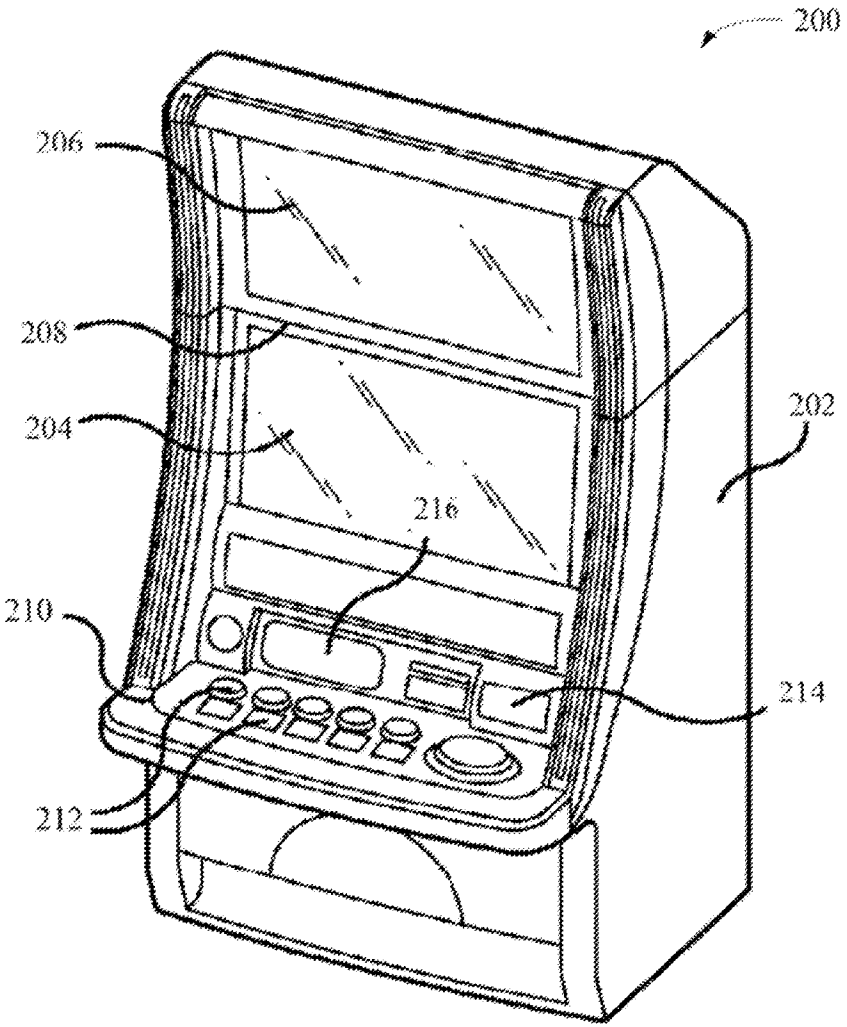
FIG. 2 is a perspective diagram of another exemplary electronic gaming machine.

With reference now to FIG. 2, another exemplary electronic gaming machine 200 is shown. Electronic gaming machine 200 includes a support structure, housing, console, or cabinet, herein referred to as a cabinet 202. Cabinet 202 provides structural support for various interfaces and displays, and, in certain embodiments, may be configured for operation by a standing or sitting player. Electronic gaming machine 200, in certain embodiments, is positioned on a base or stand. In alternative embodiments, electronic gaming machine 200 is configured as a table-top system. Electronic gaming machine 200 may include varying numbers and styles of cabinet 202 without departing from the scope of the present disclosure.

Cabinet 202 provides structural support for mounting a main video display 204 shown as a flat screen LCD, plasma, LED, OLED, PLED, SED. Moreover, main video display 204 may further include a touch screen display. Above main video display 204 is a secondary video display 206 that likewise is a flat screen LCD, plasma, LED, OLED, PLED, or SED display. In alternative embodiments, one or more of main video display 204 and secondary video display 206 may include a curved display. A mounting bezel 208 divides main display 204 from secondary display 206. A player interface, shown as a button panel 210, mounts a plurality of input buttons 212 through which a player controls an operation of a game. Below main video display 204 is an interface module 214 for interfacing with gaming machine 200, and a system interface display 216 for displaying system provided information (e.g., casino wide information and player points/comp data) to a player.

Main video display 204, in various embodiments, displays a wagering game and/or accepts game play data from a player. Moreover, main video display 204 may display information relating to an interactive game, a wager-triggering event, or a wagering outcome. Secondary video display 206 may, in certain embodiments, display digital signage, including, for example, advertisements for one or more games or other aspects of the gaming establishment or casino. Secondary video display 206 may be further configured to display wagering outcomes, secondary game data associated with or unassociated with the interactive wagering game displayed on main video display 204, and any information relating to such interactive wagering games. In certain embodiments, secondary video display 206 is further configured to receive inputs and commands from the player. Secondary video display 206, in certain embodiments, includes a credit or fund display that displays the player's current credit balance, cash accumulated, account balance, an original number of credits input to electronic gaming machine 200, or any other credit- or wager-related information. In certain embodiments, secondary video display 206 displays a wager amount for a current round of play. Secondary video display 206 may be further configured to display the player's winnings and bonus awards for the current round of play, as well as accumulated winnings and/or bonus awards.

Main video display 204 is configured to display at least one game or game image, game symbol or symbols, and game indicia, such as, for example, visual representations or exhibitions of movement of objects, including, for example, any mechanical, virtual, or video reels and wheels, dynamic lighting, video images, images of people, characters, places, things, and faces of cards. In certain embodiments, the symbols, images, and indicia are displayed mechanically on one or more mechanical reels. Such mechanical reels include an electromechanical device, such as one or more rotatable or spinning wheels, reels, or dice, any of which is configurable to display one or more games, images, symbols, or indicia. In other embodiments, the symbols, images, and indicia are display electronically, or virtually, on main video display 204.

Figure 3:
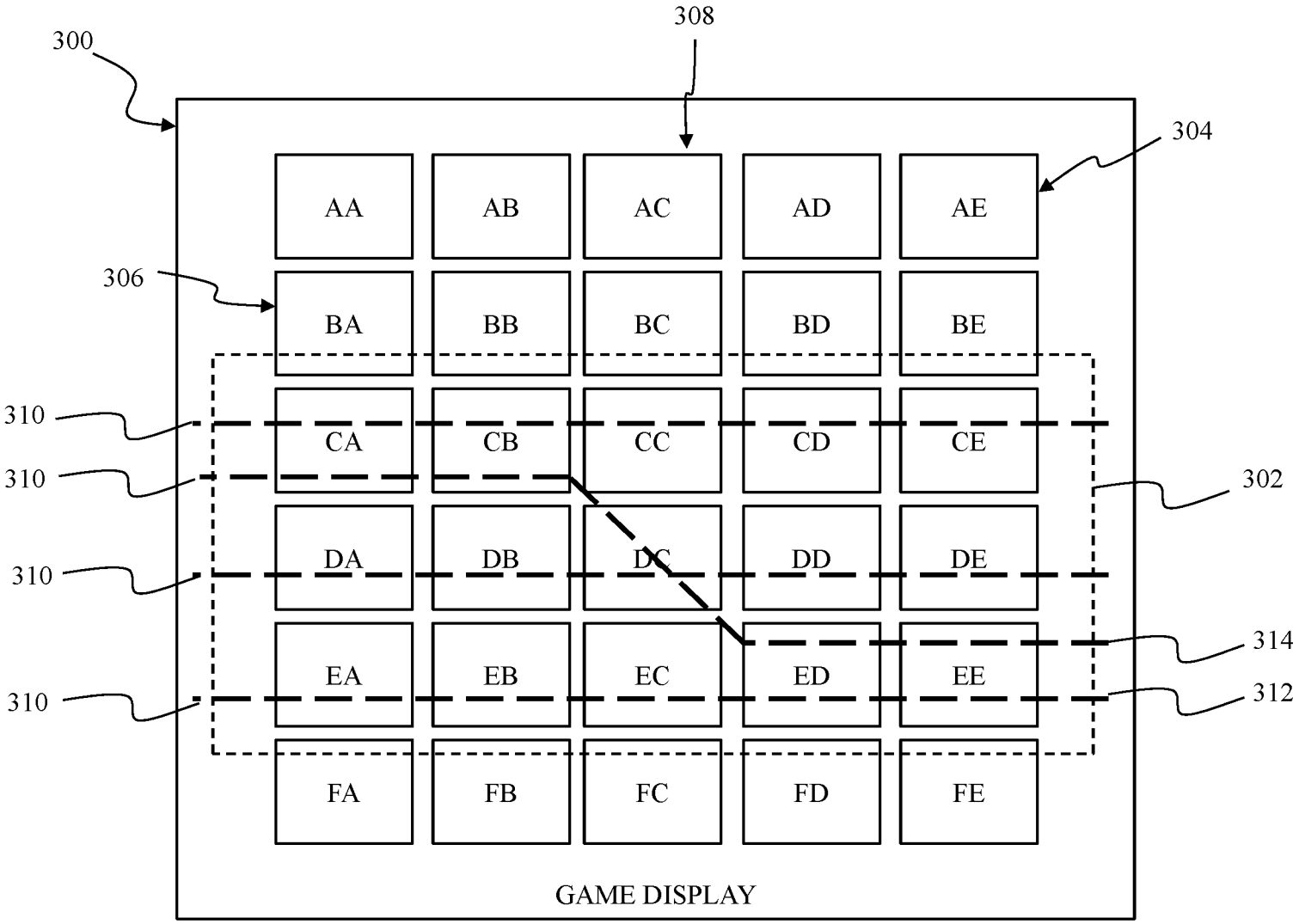
FIG. 3 is an illustrative diagram of an exemplary game display that may be used with the electronic gaming machines shown in FIGS. 1 and 2.

FIG. 3 is a illustrative diagram of a game display 300 that may be embodied in one or more of displays 114 (shown in FIG. 1), main video display 204, or secondary video display 206 (shown in FIG. 2). Game display 300 displays a matrix 302 of symbols 304, including symbols AA through FE. Symbols 304 displayed in matrix 302 are selected from a plurality of symbols arranged in rows 306 and columns 308. In certain wagering games carried out on game display 300, symbols 304 displayed in matrix 302 are combined along one or more win-lines 310 to potentially satisfy a win condition. Win conditions are generally defined as a function of win-lines 310 and the combination of symbols 304 appearing along win-lines 310. Win-lines 310 are typically defined across at least a portion of matrix 302. For example, one of win-lines 310, e.g., win-line 312 is defined across the third, or lowest row of matrix 302. Alternatively, for example, another of win-lines 310, e.g., win-line 314, is defined through a portion of each row of matrix 302 and, more specifically, through the symbol positions of symbols CA, CB, DC, ED, and EE. Win conditions typically require particular combinations of symbols appear along win-lines 310. For example, one condition may require a wild symbol appear in each symbol position along that win-line to satisfy the win condition.

Win conditions generally correspond to a payout, or win amount defined according to a pay table. The pay table is typically predefined for a particular wagering game and may be stored in local memory on the electronic gaming machine and, in certain embodiments, displayed on one or more of displays 114, main video display 204, or secondary video display 206. Win amounts may or may not be defined as a function of the wager amount.

Figure 4:
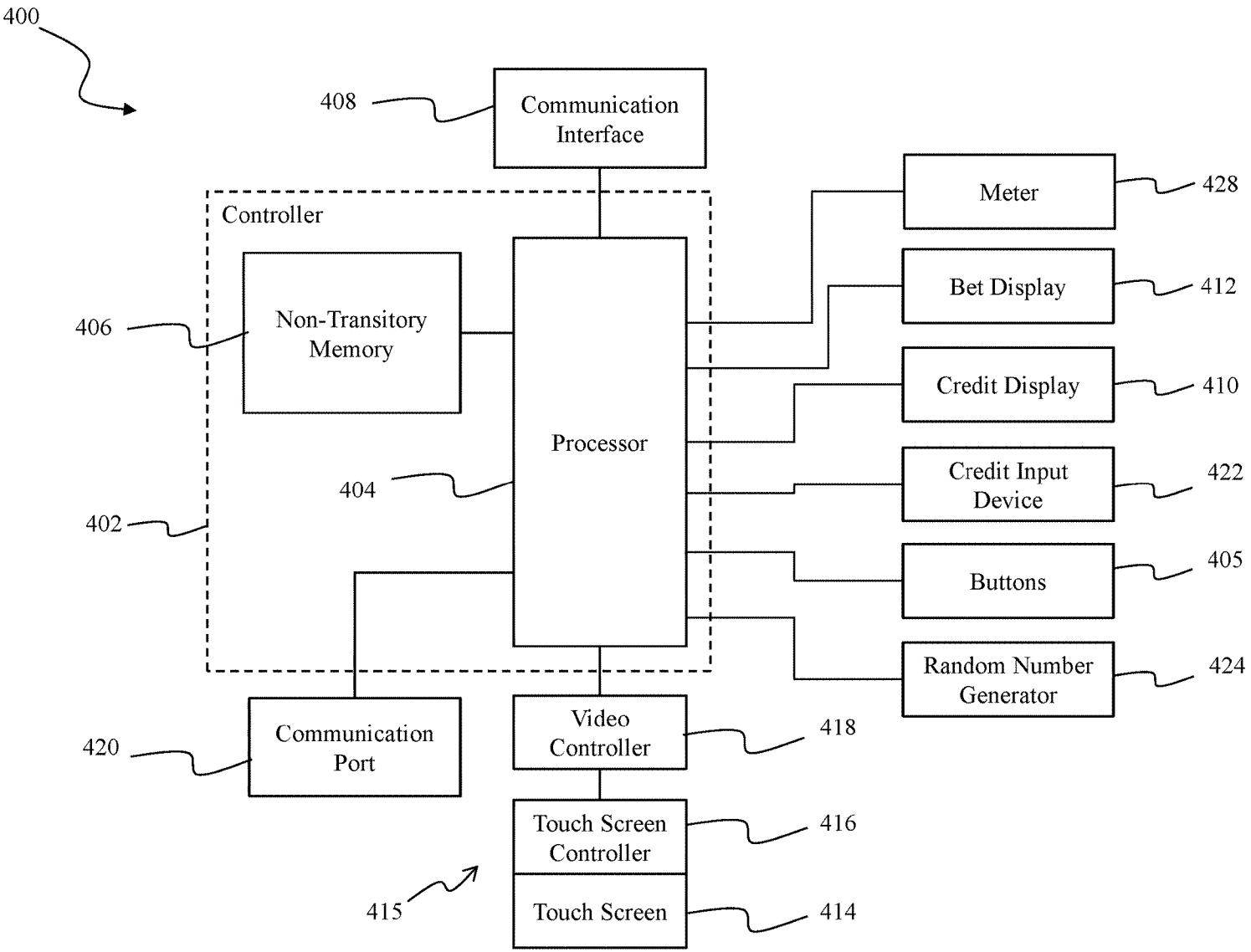
FIG. 4 is a schematic diagram of an exemplary electronic gaming machine, such as the electronic gaming machines shown in FIGS. 1 and 2.

FIG. 4 is a schematic block diagram of an electronic gaming machine 400 that may be embodied in, for example, and without limitation, electronic gaming machine 100 or 200 (shown in FIGS. 1 and 2). In the exemplary embodiment, gaming machine 400 includes a gaming machine controller 402 having a processor 404 communicatively coupled to a non-transitory memory 406. Moreover, in the exemplary embodiment, processor 404 and non-transitory memory 406 reside within a cabinet, such as cabinet 102 (shown in FIG. 1) and may be collectively referred to herein as a "computer" or "controller." Electronic gaming machine 400 is configurable and/or programmable to perform one or more operations described herein by programming processor 404. For example, processor 404 may be programmed by encoding an operation as one or more executable instructions and providing the executable instructions in non-transitory memory 406.

Controller 402 communicates with one or more other electronic gaming machines 400 or other suitable devices via a communication interface 408. Communication interface 408 may operate as an input device (e.g., by receiving data from another device) and/or as an output device (e.g., by transmitting data to another device). Electronic gaming machine 400 includes one or more buttons 405, such as buttons 104 or buttons 212 shown in FIGS. 1 and 2. Processor 404 may be a microprocessor, a microcontroller-based platform, a suitable integrated circuit, and/or one or more application-specific integrated circuits (ASICs). However, the above examples are exemplary only, and thus are not intended to limit in any way the definition and/or meaning of the term "processor." Electronic gaming machine 400 includes a random number generator 424. In certain embodiments, random number generator 424 is integrated into controller 402 or processor 404. Random number generator 424 is configured to be secure from unauthorized access, manipulation, or compromise. Generally, an output of random number generator 424 is the basis on which game outcomes are determined by controller 402, and includes both random and pseudo random numbers.

In certain embodiments, data and the computer-executable instructions may be stored in a cloud service, a database, or other non-transitory memory accessible by electronic gaming machine 400. Such embodiments reduce the computational and storage burden on electronic gaming machine 400. As such, non-transitory memory 406 may be a local and/or a remote computer storage media including memory storage devices. Moreover, non-transitory memory 406 may include one or more forms of memory. For example, non-transitory memory 406 can include random access memory (RAM), read-only memory (ROM), flash memory, and/or electrically erasable programmable read-only memory (EEPROM). In some embodiments, other suitable magnetic, optical, and/or semiconductor-based memory may be included in non-transitory memory 406 by itself or in combination.

When games are implemented in an online environment, at least a portion of the game software is stored in a remote game server, or in a cloud computing service. Game transactions such as adding money to the game, i.e., cash in, and withdrawing money from the game, i.e., cash out, are substituted by implementing electronic fund transfers. Each player deposits money into his online gaming account via checks, debit cards, wire and the like. Once funded, the player can move a portion of the cash in his account into the game he wants to play. This process is referred to as account-based wagering. Account-based wagering is a convenient monetary transaction system for online and mobile wagering environments since the physical bill acceptor and ticket printer are not available. In addition to the accounting meters' separation requirement, the detection of the location where the wagering transaction take place is also required in order to enforce local gaming regulations and to properly calculate revenue, profit, and tax withholdings, for example.

Non-transitory memory 406, in certain embodiments, is a physical storage device, such as, for example, a cartridge that is removable from electronic gaming machine 400. Further, in certain embodiments, non-transitory memory 406 includes multiple removable physical storage devices, each configured to store certain executable program modules. In alternative embodiments, non-transitory memory 406 includes multiple partitions of a single physical storage device, each partition configured to store certain executable program modules.

Electronic gaming machine 400 includes a credit input device 422 for accepting various forms of money or credit. Credit input device 422 may include one or more of a coin acceptor, bill validator, ticket reader, or card reader, for example. In certain embodiments, credit input device 422 includes an interface to a server configured to accept credits to establish a credit balance at electronic gaming machine 400. Electronic gaming machine 400 further includes at least one meter 428 for tracking and recording gaming data, including, for example amounts wagered on electronic gaming machine 400.

Electronic gaming machine 400 includes a credit display 410 that displays a player's current number of credits, cash, account balance or the equivalent. Electronic gaming machine 400 also includes a bet display 412 that displays a player's amount wagered. Credit display 410 and bet display 412 may be standalone displays independent of a display 415, such as, for example, displays 114, main video display 204, or secondary video display 406, or credit display 410 and bet display 412 may be incorporated into display 415.

Moreover, in an exemplary embodiment, display 415 is controlled by controller 402. In some embodiments, display 415 includes a touch screen 414 and an associated touch screen controller 416. In such embodiments, display 415 may operate as an input device in addition to presenting information. A video controller 418 is communicatively coupled to controller 402 and touch screen controller 416 to enable a player to input game play decisions (e.g., actions on and selections of game presentation objects) into electronic gaming machine 400 via touch screen 414. Furthermore, electronic gaming machine 400 includes one or more communication ports 420 that enable controller 402 to communicate with external peripheral devices (not shown) such as, but not limited to, external video sources, expansion buses, other displays, a SCSI port, or a key pad.

Controller 402 selects symbols 304 that are displayed in matrix 302. Moreover, controller 402 determines whether a win condition exists and any win amounts that should be awarded to the player. Controller 402, in certain embodiments, selects a trigger symbol to be displayed in matrix 302. The trigger symbol corresponds to a multiplier feature that, when applied results in a multiple of winnings in the wagering being awarded and a multiple of the amount wagered being awarded.

Figure 5:
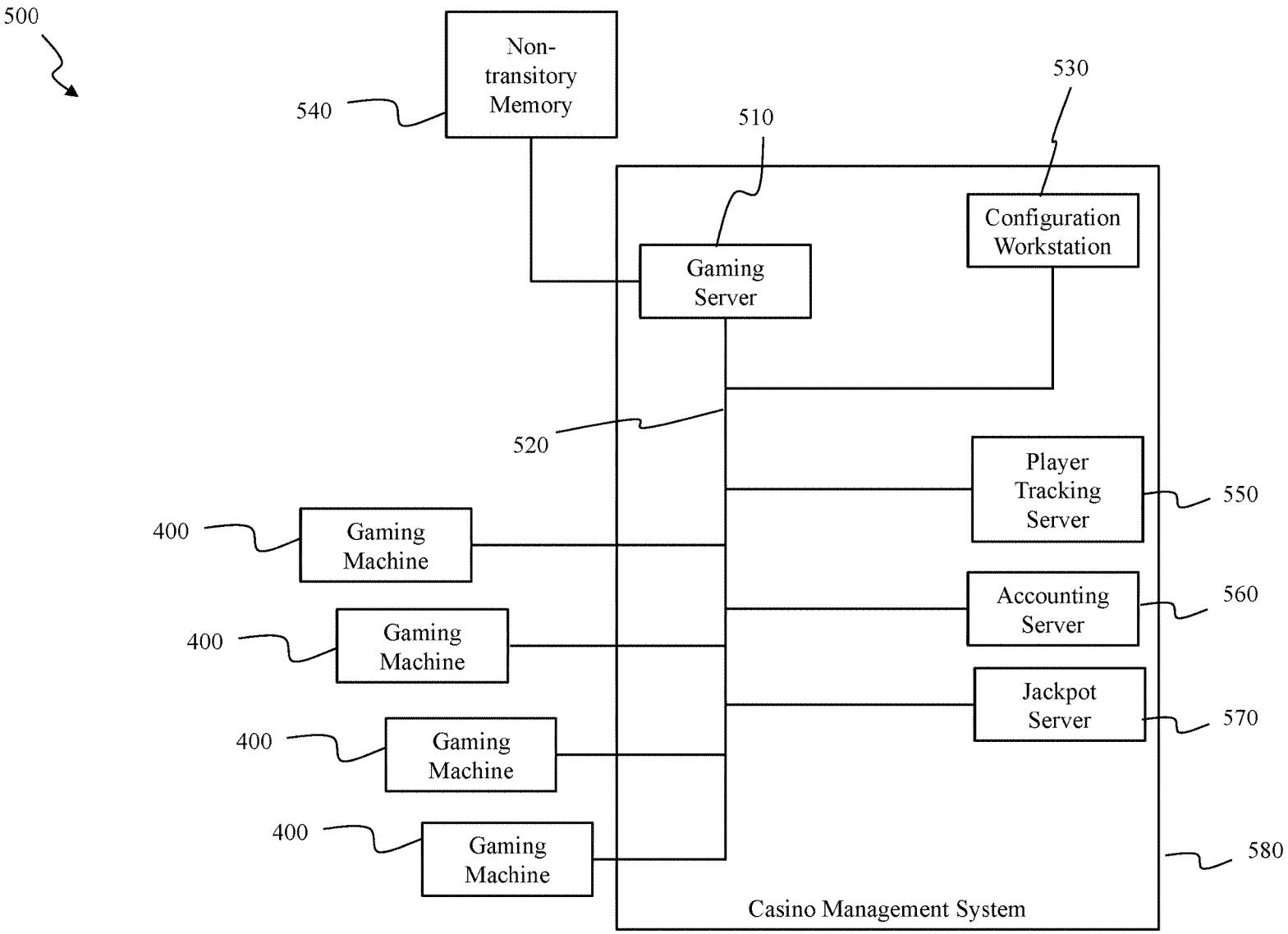
FIG. 5 is a block diagram of a gaming system in which the electronic gaming machines shown in FIGS. 1 and 2 may be embodied.

FIG. 5 is a block schematic diagram of an exemplary electronic gaming system 500 that includes a plurality of electronic gaming machines 400 (shown in FIG. 4). In alternative embodiments, electronic gaming system 500 may be implemented using electronic gaming machine 100 or 300 shown in FIGS. 1 and 2. Each gaming machine 400 is coupled via communication interface 408 (shown in FIG. 4) to one or more servers, such as a gaming server 510, using a network 520. In certain embodiments, gaming system 500 may include a player tracking server 550, an accounting server 560, and a bonus server 570. Gaming server 510, player tracking server 550, accounting server 560 and bonus server 570 combine to form a casino management system 580. Gaming server 510 may have an electrical architecture similar to that of electronic gaming machine 400. Gaming server 510 includes a processor (not shown) and a network interface, such as communication port 420 that facilitates data communication between gaming server 510, each gaming machine 400, and other components of gaming system 500. Such data is stored in, for example, a non-transitory memory 540, such as a database, that is coupled to gaming server 510.

Casino management system 580 includes a configuration workstation 530 coupled to server 510 and gaming machines 400 through network 520. In one embodiment, one or more gaming machines 400 may be remote gaming machines that access a casino via network 520. As such, a player is able to participate in a game of chance on a remote gaming machine. In such an embodiment, it will be understood that a player operating a remote gaming machine has virtual access to any casino coupled to network 520 and associated with gaming server 510. Gaming machines 400 may also be a personal computers coupled to the Internet via a virtual private network such that a player may participate in a game of chance, remotely. In other embodiments, the player may use a cell phone or other mobile devices (e.g., tablets, PDAs, laptops, and the like) coupled to a wired or wireless communication network to establish a connection with a particular casino. Moreover, gaming machines 400 may be terminal-based machines, such as, for example, electronic gaming machines 100 and 200, wherein the actual games, including random number generation and/or outcome determination, are performed at gaming server 510. In such an embodiment, gaming machines 400 display results of a game via displays 114, main video display 204, or secondary video display 206 (shown in FIGS. 1 and 2).

In one embodiment, gaming server 510 performs a plurality of functions including, game outcome generation, player tracking functions, and/or accounting functions, to name a few. For example, gaming server 510 may track data of players using gaming machines 400. For example, gaming server 510 can store physical characteristics of players, such as, but not limited to, a gender of a player and an age of a player. Gaming server 510 can also track and store other data related to the players using player tracking identification, such as a player card. For example, gaming server 510 can store information about a player, such as loyalty points, player address, phone number, and/or any information that may be retrieved and transmitted to gaming machines 400. In alternative embodiments, gaming system 500 may include a plurality of servers that separately perform these functions and/or any suitable function for use in a network-based gaming system.

Casino management system 580 includes at least one processor among gaming server 510, configuration workstation 530, player tracking server 550, accounting server 560, and bonus server 570. Casino management system 580 is coupled to gaming machines 400 over network 520. Casino management system 580 is configured to receive gaming data from gaming machines 400 as each of gaming machines 400 conducts various rounds of play of one or more wagering games.

A wagering game is carried out on at least one gaming machine 400, for example, by controller 402 (shown in FIG. 4). Controller 402 conducts the wagering game and generates gaming data. Gaming data may include, for example, wagers, game outcomes, payouts, player ratings, duration of play, and time between rounds of play. For each round of play of the wagering game, controller 402 conducts the wagering game and awards a payout, or win amount according to a pay table for electronic gaming machine 400. Further controller 402 is configured to apply a multiplier feature when a trigger symbol appears in matrix 302.

Figure 6:
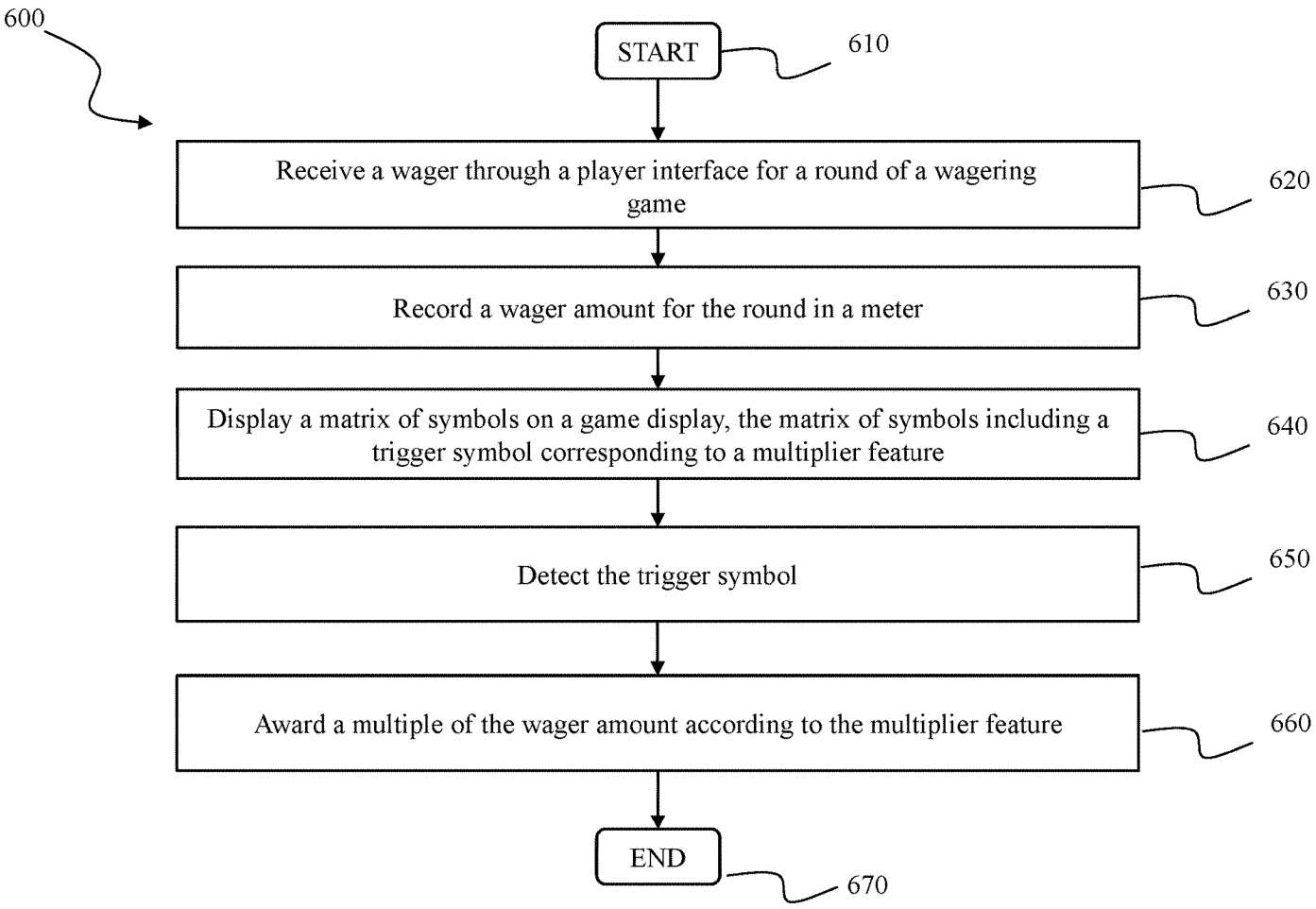
FIG. 6 is a flow diagram of an exemplary method of conducting a wagering game on the electronic gaming machines shown in FIGS. 1 and 2.

FIG. 6 is a flow diagram of an exemplary method 600 of conducting a wagering game on an electronic gaming machine, such as, for example, electronic gaming machine 100, 200, or 400 (shown in FIGS. 1, 2, and 4). Method 600 begins at a start step 610. At a receiving step 620, a wager is received through a player interface for a round of the wagering game. A wager amount for the round is recorded in a meter at a recording step 630. At a displaying step 640, a matrix of symbols are display on a game display. The matrix of symbols includes a trigger symbol corresponding to a multiplier feature. The trigger symbol is detected at a detection step 650. At an awarding step 660, a multiple of the wager amount is awarded according to the multiplier feature. Method 600 terminates at an end step 670.

Exemplary technical effects of the systems, methods, and apparatus described herein include at least one of: (a) enabling a minimum bonus award on electronic gaming machines; (b) defining a minimum bonus award for an electronic gaming machine as a function of an amount wagered; (c) dynamically defining minimum bonus awards for multiple electronic gaming machines based on amounts wagered on the multiple electronic gaming machines; (d) improving player experience for multiplier features through enabling a minimum bonus award; (e) dynamically defining minimum bonus awards for multiplier features according to an amount wagered; (f) eliminating the need for uniform fixed schedules of minimum bonus awards for multiple electronic gaming machines in a given casino; and (g) more efficiently allocating bonus award funds to players placing larger wagers.

Further, the systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

A computer, controller, or server, such as those described herein, includes at least one processor or processing unit and a system memory. The computer, controller, or server typically has at least some form of computer readable non-transitory media. As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit, and other programmable circuits "configured to" carry out programmable instructions, and these terms are used interchangeably herein. In the embodiments described herein, memory may include, but is not limited to, a computer-readable medium or computer storage media, volatile and nonvolatile media, removable and non-removable media implemented in any method or technology for storage of information such as computer readable instructions, data structures, program modules, or other data. Such memory includes a random access memory (RAM), computer storage media, communication media, and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Further, as used herein, the terms "software" and "firmware" are interchangeable, and include any computer program stored in memory for execution by personal computers, workstations, clients and servers.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

Although the present disclosure is described in connection with an exemplary gaming system environment, embodiments of the present disclosure are operational with numerous other general purpose or special purpose gaming system environments or configurations. The gaming system environment is not intended to suggest any limitation as to the scope of use or functionality of any aspect of the disclosure. Moreover, the gaming system environment should not be interpreted as having any dependency or requirement relating to any one or combination of components illustrated in the exemplary operating environment.

Embodiments of the present disclosure may be described in the general context of computer-executable instructions, such as program components or modules, executed by one or more computers or other devices. Aspects of the present disclosure may be implemented with any number and organization of components or modules. For example, aspects of the present disclosure are not limited to the specific computer-executable instructions or the specific components or modules illustrated in the figures and described herein. Alternative embodiments of the present disclosure may include different computer-executable instructions or components having more or less functionality than illustrated and described herein.

The order of execution or performance of the operations in the embodiments of the present disclosure illustrated and described herein is not essential, unless otherwise specified. That is, the operations may be performed in any order, unless otherwise specified, and embodiments of the present disclosure may include additional or fewer operations than those disclosed herein. For example, it is contemplated that executing or performing a particular operation before, contemporaneously with, or after another operation is within the scope of aspects of the present disclosure.

When introducing elements of aspects of the present disclosure or embodiments thereof, the articles "a," "an," "the," and "said" are intended to mean that there are one or more of the elements. The terms "comprising," including," and "having" are intended to be inclusive and mean that there may be additional elements other than the listed elements.

The present disclosure uses examples to disclose the best mode, and also to enable any person skilled in the art to practice the claimed subject matter, including making and using any devices or systems and performing any incorporated methods. The patentable scope of the present disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An electronic gaming machine comprising:

a player interface configured to receive at least one an input from a player;

a memory configured to store at least one output table and a plurality of win conditions; and a game controller in communication with the player interface and the memory, the game controller configured to:

receive, from the player interface, an input including an input amount for a round of a game;

select a matrix of symbols for display during the round of the game;

detect a trigger symbol included in the matrix of symbols, the trigger symbol corresponding to a multiplier feature, the multiplier feature corresponding to a value by which at least one output is multiplied;

determine a first output according to the input amount and the multiplier feature;

determine whether any win conditions of the plurality of win conditions exist within the matrix of symbols; and determine a second output according to the determined win conditions, the at least one output table, and the multiplier feature.

2. The electronic gaming machine of claim 1, wherein the game controller is further configured to determine the second output according to the determined win conditions, the at least one output table, and the multiplier feature, wherein the determined win conditions include no win conditions and the second output includes an output amount of zero.

3. The electronic gaming machine of claim 1, wherein the game controller is further configured to determine the second output according to the determined win conditions, the at least one output table, and the multiplier feature, wherein the determined win conditions include at least one win condition of the plurality of win conditions and the second output includes an output amount greater than zero.

4. The electronic gaming machine of claim 1, wherein the game controller is further configured to multiply the input amount by a scalar value defined by the multiplier feature.

5. The electronic gaming machine of claim 4 further comprising a random number generator configured to generate a random number, and wherein the game controller is further configured to compute the scalar value according to the random number.

6. The electronic gaming machine of claim 1, wherein the game controller is further configured to determine whether any win conditions of the plurality of win conditions exist along a win-line in the matrix of symbols.

7. The electronic gaming machine of claim 1 further comprising a meter configured to record at least the input amount.

8. An electronic gaming system comprising:

a player interface configured to receive at least one an input from a player;

a memory configured to store at least one output table and a plurality of win conditions; and a game controller in communication with the player interface and the memory, the game controller configured to:

receive, from the player interface, an input including an input amount for a round of a game;

select a matrix of symbols for display during the round of the game;

detect a trigger symbol included in the matrix of symbols, the trigger symbol corresponding to a multiplier feature, the multiplier feature corresponding to a value by which at least one output is multiplied;

determine a first output according to the input amount and the multiplier feature;

determine whether any win conditions of the plurality of win conditions exist within the matrix of symbols; and determine a second output according to the determined win conditions, the at least one output table, and the multiplier feature.

9. The electronic gaming system of claim 8, wherein the game controller is further configured to determine the second output according to the determined win conditions, the at least one output table, and the multiplier feature, wherein the determined win conditions include no win conditions and the second output includes an output amount of zero.

10. The electronic gaming system of claim 8, wherein the game controller is further configured to determine the second output according to the determined win conditions, the at least one output table, and the multiplier feature, wherein the determined win conditions include at least one win condition of the plurality of win conditions and the second output includes an output amount greater than zero.

11. The electronic gaming system of claim 8, wherein the game controller is further configured to multiply the input amount by a scalar value defined by the multiplier feature.

12. The electronic gaming system of claim 11 further comprising a random number generator configured to generate a random number, and wherein the game controller is further configured to compute the scalar value according to the random number.

13. The electronic gaming system of claim 8, wherein the game controller is further configured to determine whether any win conditions of the plurality of win conditions exist along a win-line in the matrix of symbols.

14. The electronic gaming system of claim 8 further comprising a meter configured to record at least the input amount.

15. A method of electronic gaming utilizing a game controller in communication with a player interface and a memory, the player interface configured to receive an input from a player for a round of a game, wherein the input includes an input amount, and the memory configured to store at least one output table and a plurality of win conditions, the method comprising, by the game controller:

selecting a matrix of symbols for display during the round of the game;

detecting a trigger symbol included in the matrix of symbols, the trigger symbol corresponding to a multiplier feature, the multiplier feature corresponding to a value by which at least one output is multiplied;

determining a first output according to the input amount and the multiplier feature;

determining whether any win conditions of the plurality of win conditions exist within the matrix of symbols; and determining a second output according to the determined win conditions, the at least one output table, and the multiplier feature.

16. The method of claim 15 further comprising, by the game controller, determining the second output according to the determined win conditions, the at least one output table, and the multiplier feature, wherein the determined win conditions include no win conditions and the second output includes an output amount of zero.

17. The method of claim 15 further comprising, by the game controller, determining the second output according to the determined win conditions, the at least one output table, and the multiplier feature, wherein the determined win conditions include at least one win condition of the plurality of win conditions and the second output includes an output amount greater than zero.

18. The method of claim 15 further comprising, by the game controller, multiplying the input amount by a scalar value defined by the multiplier feature.

19. The method of claim 18 further comprising, by the game controller, computing the scalar value according to a random number generated by a random number generator in communication with the game controller.

20. The method of claim 15 further comprising, by the game controller, determining whether any win conditions of the plurality of win conditions exist along a win-line in the matrix of symbols.

* * * * *